United States Patent [19]

Leone

[11] 3,964,217

[45] June 22, 1976

[54] LOAD BEARING BEAM FOR FLOORS AND THE LIKE

[76] Inventor: Salvatore Leone, Residenza al Parco No. 11.3.301, Milan 2 - 20090 Segrate, Italy

[22] Filed: Jan. 9, 1975

[21] Appl. No.: 539,578

[30] Foreign Application Priority Data

Sept. 26, 1974 Italy ..... 27717/74

[52] U.S. Cl. ..... 52/86; 52/648

[51] Int. Cl.² ..... E04B 1/32; E04H 12/10

[58] Field of Search ..... 52/86, 633, 648, 650, 52/651

[56] References Cited

UNITED STATES PATENTS 3,583,121 6/1971 Tate et al. ..... 52/648

FOREIGN PATENTS OR APPLICATIONS 1,184,408 2/1959 France ..... 52/648

1,276,399 10/1961 France ..... 52/648

*Primary Examiner*—J. Karl Bell

*Attorney, Agent, or Firm*—Phillips, Moore, Weissenberger Lempio & Strabala

[57] ABSTRACT

A metal load bearing beam for floors and the like has support elements secured on each end of its base plate. Such support elements are L-shaped to comprise bent portions projecting outwardly on opposite ends of the beam in substantial coplanar relationship with the base plate.

8 Claims, 3 Drawing Figures

LOAD BEARING BEAM FOR FLOORS AND THE LIKE

BACKGROUND OF THE INVENTION

The present invention relates to a metallic load bearing beam for structural members, such as floors, having support elements thereon for supporting the beam on pillars or the like.

A standard steel I-beam has a cross section shaped as an inverted "T" to comprise a large supporting base plate or lower stringer, a central web perpendicular to the base and an elongated upper stringer, extending along the upper end of the central web. It is also well known in the building arts that the web connecting the lower and upper stringers together is formed with apertures so that a concrete casting can be integrated therewith for building purposes.

Further, it is well known that the central web may be constructed from a row of inclined rods, each fixed at one end to the lower stringer and at the other end to the upper stringer, formed of a pair of tubular elements parallel to each other and to the lower stringer. Such inclined rods forming the web are affixed not only to the upper stringer and the base, but also to each other to provide a series of V-shapes, or a continuous sinusoid, the top and bottom peaks of which are respectively fixed to the pair of tubular elements forming the upper stringer and to the lower stringer.

In another prior art application, the beam web is constructed from a series of pairs of inclined rods, each fixed at one end to the lower stringer and at the other end to an upper stringer, formed in this case of a single tubular element parallel to the lower stringer. Also, each of the rods forming the beam web is affixed to the ends of the adjacent rods, so as to provide two rows of V-shapes, or two continuous sinusoids, quite similar to those of the foregoing case, except for their shape.

It is apparent that a beam of this type has the advantage that the lower stringer or base of the beam functions as a support element to support the beam on a pair of pillars, for example, and at the same time functions as the load bearing member for floor components resting on the beam. Of course, to ensure the structural integrity between the beam and the supporting pillars, and to avoid imperfect penetration of a concrete casting between the beam and the pillars whereby voids may be formed therebetween, supporting end members have been adapted to the beam.

Such end members usually comprise a transverse element joined to the base of the beam. However, it has also been found that this arrangement is not satisfactory, as the connection with the pillar is imperfect and some difficulties are met when this transverse member is inserted between longitudinal rods of the pillar reinforcement.

SUMMARY OF THE INVENTION

It is an object of the present invention to provide a metal load bearing beam for floors and the like of the above-mentioned type, having end members which alleviate the above-mentioned drawbacks. In particular, the end members allow concrete to perfectly penetrate between the beam ends and the supporting pillar, thus incorporating them into a unitary structure, and also avoids interference with the inner reinforcement of the pillar itself.

The beam of the present invention comprises a base, a web of stiffeners secured on the base and an upper stringer secured along the top of said web. A support element has a first segment secured to the base and a second segment projecting in cantilevered relationship therebeyond. In the preferred embodiment of this invention, the support element is L-shaped and a pair thereof are secured to each end of the base in substantially coplanar relationship therewith. Furthermore, the base may comprise a pair of longitudinally spaced portions secured together by a pair of elongated elements adapted for support by a bracket or the like.

BRIEF DESCRIPTION OF THE DRAWINGS

Further objects, advantages and features of the beam according to the present invention will be apparent to those skilled in the art from the following detailed description of an embodiment thereof, given of a non-limiting example, with reference to the annexed drawing, wherein.

DETAILED DESCRIPTION

Figure 1:
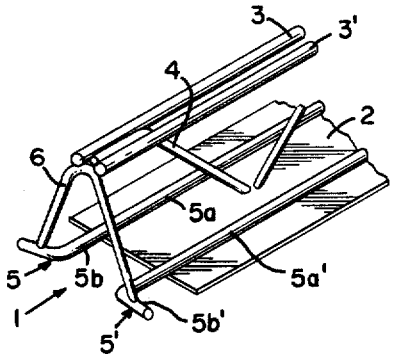
FIG. 1 is a partial perspective view of a beam according to the present invention, at an end segment thereof.

With reference to the drawing, FIG. 1 shows the end segment of a steel floor beam 1 of this invention comprising a flat lower stringer or base plate 2, an upper stringer formed of two tubular elements 3 and 3', both parallel to the base, and a central web formed of a multiplicity of inclined rods or stiffeners 4. The lower or first ends of the rods are suitably secured to base 2 and the upper or second ends thereof are suitably bent and secured between elements 3 and 3' of the upper stringer. Rods 4 define a series of V's or the continuous sinusoidal line in a plane perpendicular to base 2 and median thereof and to the tubular elements 3, 3'.

It is obvious that for the purposes of the invention, the beam could also be different, provided that its lower stringer is formed with a flat base plate. In particular, the beam could be shaped according to the beam described above wherein the upper stringer comprises only one longitudinal tubular element and the so-called web comprises two series of V-shaped inclined rods which form two continuous sinusoids in two angled planes, passing through the upper stringer itself.

The end members of the beam comprise two rods or metallic (e.g., steel) support elements 5 and 5', suitably secured to base 2, preferably by welding, along first segments **5*a* and 5*a'* thereof, respectively. Such two segments are substantially rectilinear, mutually parallel to the longitudinal sides of base 2, as well as to the upper stringer. The ends or second segments 5*b* and 5*b'* ends or second segments 5*b* and 5*b'* of the end members each protrudes longitudinally beyond the end of base 2** and is bent into an L-shape to extend outwardly from the longitudinal median axis of the base and away from each other.

According to the embodiment of FIG. 1, the beam is further provided with an end stiffener 6, having an inverted V-shape. The stiffener has its lower or first ends suitably secured to segments **5*b* and 5*b'*, respectively, and its apex or upper second end suitably secured to elements 3 and 3'** of the upper stringer.

Figure 2:
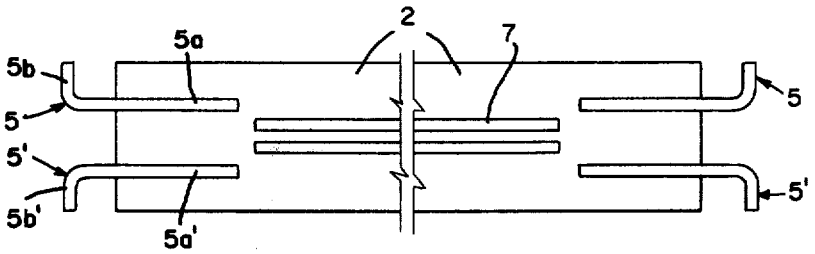
FIG. 2 is a diagrammatic, fragmentary top plan view of a lower stringer or base of the beam comprising a pair of spaced portions secured together by a pair of rods.

As it is better shown in FIG. 2, rectilinear segments 5*a* and 5*a* ' of the end members preferably have the same length and are welded upon the upper surface of base 2, symmetrically thereto and therefore with respect to the upper stringer. Furthermore, protruding segments 5*b* and 5*b'* are bent at opposite sides, substantially with the same bending radius, and preferably have the same length, still being substantially coplanar with respect to base 2. Consequently, end members 5 and 5' are substantially symmetrical relative to the longitudinal median axis of base 2, and thus to the central web of the upper stringer.

FIG. 2 further illustrates a particular embodiment of a beam according to the present invention, which is constructed and arranged to contact with an intermediate cantilevered supporting element, such as a bracket (not shown). In this embodiment, base 2 is broken at the point of contact with such cantilevered element and the beam's continuity is ensured by a pair of tubular elongated elements 7 suitably secured on the upper surface of the longitudinally spaced portions of the base, along a certain length at both sides of the interruption.

Figure 3:
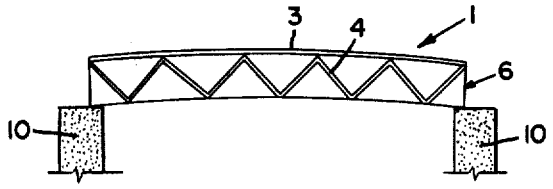
FIG. 3 is a diagrammatic front elevational view of a beam according to the present invention, resting on a pair of spaced pillars.

FIG. 3 diagrammatically shows beam 1, utilized as the skeleton of a floor or covering for a vault, supported at its ends by a pair of pillars or columns 10. From the foregoing, it is apparent that end members such as those described and illustrated at 5 and 5' do not interfere with the upright reinforcing rods (not shown) of pillars 10 and, therefore, a concrete casting is fully unitized with the beam and the pillars without giving rise to structural discontinuities.

Possible additions and/or modifications could be carried out by those skilled in the art to the above described and illustrated embodiment of a beam with improved end members according to the present invention, without exceeding the scope of the invention itself. In particular, as previously stated, the beam structure could be different from that described and illustrated, provided that it comprises a metallic lower supporting flat base. It should be understood that the beam's component parts are preferably fabricated from conventional steel or other suitable building materials and welded one to another. Furthermore, the overall shape of base 2 and/or the upper stringer are preferably flat but may be slightly arcuate, as illustrated in FIG. 3.

I claim:

1. A structural load bearing beam for floors and the like comprising a base disposed on a longitudinal median axis thereof, stiffening means secured at a lower end thereof to said base and projecting upwardly therefrom, stringer means secured on an upper end of said stiffening means, and a pair of L-shaped and transversely spaced support elements substantially co-planar with respect to said base and each having a first segment secured and confined on an end and outer surface of said base and a second segment projecting in cantilevered relationship beyond the end of said base, the second segments of said support elements extending away from each other and outwardly from said axis.

2. The beam of claim 1 wherein the first segments are substantially parallel and straight and the second segments thereof extend away from each other to terminate at their outer ends in substantial co-extensive relationship relative to the width of said base.

3. The beam of claim 1 wherein said first segments have the same length and are symmetrical relative to said axis and parallel to said stringer means.

4. The beam of claim 3 wherein a pair of said support elements are secured on each end of said base.

5. The beam of claim 1 further comprising an end stiffener, having an inverted U-shape, secured at its lower ends to the second segments of said support elements and its upper apex end secured to said stringer means.

6. The beam of claim 1 wherein said base comprises a pair of longitudinally spaced portions secured together by a pair of elongated elements.

7. The beam of claim 4 wherein each pair of said support members are mounted on a pillar.

8. The beam of claim 1 wherein each of said base, stiffening means, stringer means and support element are metallic and secured together by welds.

* * * * *